US008621740B2

(12) United States Patent
Reedijk et al.

(10) Patent No.: US 8,621,740 B2
(45) Date of Patent: Jan. 7, 2014

(54) WATER-RETAINING ELEMENT, SYSTEM AND METHOD FOR FORMING A TEMPORARY WATER-RETAINING STRUCTURE

(75) Inventors: Jan Sebastiaan Reedijk, Gouda (NL); Erik ten Oever, Leiden (NL); Joachim Matthijs van Gaalen, Gouda (NL); Peter Gerardes van Duijnen, Culemborg (NL); Herke Gerrit Stuit, Hoofddorp (NL)

(73) Assignees: Koninklijke BAM Groep N.V., Bunnik (NL); Movares Nederland B.V., Utrecht (NL)

( * ) Notice: Subject to any disclaimer, the term of this patent is extended or adjusted under 35 U.S.C. 154(b) by 773 days.

(21) Appl. No.: 12/667,649

(22) PCT Filed: Jul. 7, 2008

(86) PCT No.: PCT/NL2008/000171

§ 371 (c)(1),
(2), (4) Date: Mar. 19, 2010

(87) PCT Pub. No.: WO2009/005342

PCT Pub. Date: Jan. 8, 2009

(65) Prior Publication Data

US 2010/0186216 A1 Jul. 29, 2010

(30) Foreign Application Priority Data

Jul. 5, 2007 (NL) ..... 1034103

(51) Int. Cl.
*B23P 11/02* (2006.01)
*E02B 7/08* (2006.01)
*E02B 7/14* (2006.01)
*B23P 11/00* (2006.01)

(52) U.S. Cl.
USPC ..... 29/453; 405/114; 405/111; 405/107; 29/469; 29/525.01; 29/428

(58) Field of Classification Search
USPC ..... 29/433, 453, 469, 428, 525.01; 405/114, 111, 107, 15, 31, 16, 21, 286
See application file for complete search history.

(56) References Cited

U.S. PATENT DOCUMENTS 2,511,902 A 6/1950 Cabrera
3,213,628 A * 10/1965 Serota ..... 405/111
3,597,928 A * 8/1971 Pilaar ..... 405/20
3,901,406 A * 8/1975 Kivett ..... 220/8

(Continued)

FOREIGN PATENT DOCUMENTS

DE 10117109 A1 12/2002
DE 20302290 U1 5/2003

(Continued)

*Primary Examiner* — Essama Omgba
(74) *Attorney, Agent, or Firm* — Hoffmann & Baron, LLP

(57) ABSTRACT

A water-retaining element (2) for forming a temporary water-retaining structure (1) includes a bottom (6), a plurality of side walls (8, 10), and connections (20). The plurality of side walls are immovably connected to the bottom and extend upwards from the bottom to form a water-fillable container (12). The connections connect the water-retaining element in a water-retaining manner to least one adjacent water-retaining element. The water-fillable container (12) is open at the top to receive a second water-retaining element (2) during transport and/or storage.

11 Claims, 4 Drawing Sheets

(56) References Cited

U.S. PATENT DOCUMENTS

| | | | | | |
|---|---|---|---|---|---|
| 3,969,900 | A * | 7/1976 | Plodowski | 405/23 |
| 4,227,829 | A * | 10/1980 | Landry, Jr. | 405/20 |
| 4,370,075 | A * | 1/1983 | Scales | 405/20 |
| 4,593,816 | A * | 6/1986 | Langenbeck | 206/425 |
| 4,692,060 | A * | 9/1987 | Jackson, III | 405/115 |
| 5,114,270 | A * | 5/1992 | Riddle | 405/15 |
| 5,167,843 | A * | 12/1992 | Guillory | 249/83 |
| 5,429,450 | A | 7/1995 | Meidinger | |
| 5,511,902 | A | 4/1996 | Center | |
| 6,012,872 | A * | 1/2000 | Perry et al. | 405/114 |
| 6,485,230 | B2 * | 11/2002 | Robinson | 405/64 |
| 6,588,979 | B1 * | 7/2003 | Pasij | 405/114 |
| 6,708,824 | B2 * | 3/2004 | Sahm, III | 206/505 |
| 7,037,037 | B1 * | 5/2006 | Smith et al. | 405/20 |
| 7,431,534 | B2 * | 10/2008 | Harbeck | 405/114 |
| 7,651,298 | B2 * | 1/2010 | Boudreaux, Jr. | 405/111 |
| 7,708,495 | B1 * | 5/2010 | Antee | 405/114 |
| 7,762,205 | B1 * | 7/2010 | Veazey | 114/267 |
| 8,177,457 | B2 * | 5/2012 | Boudreaux, Jr. | 405/114 |
| 8,430,597 | B2 * | 4/2013 | Shipley et al. | 405/79 |
| 2004/0156680 | A1 * | 8/2004 | Gibbs | 405/15 |
| 2007/0116522 | A1 * | 5/2007 | Boudreaux, Jr. | 405/114 |
| 2010/0284747 | A1 * | 11/2010 | Peterson et al. | 405/114 |

FOREIGN PATENT DOCUMENTS

| | | | | |
|---|---|---|---|---|
| EP | 1614811 | A1 | 1/2006 | |
| FR | 2865483 | A1 | 7/2005 | |
| GB | 922200 | | 3/1963 | |
| JP | 08109624 | A * | 4/1996 | E02B 13/00 |
| JP | 2000273856 | A * | 10/2000 | E02B 13/00 |

* cited by examiner

WATER-RETAINING ELEMENT, SYSTEM AND METHOD FOR FORMING A TEMPORARY WATER-RETAINING STRUCTURE

CROSS-REFERENCE TO RELATED APPLICATIONS

This application is the National Stage of International Application No. PCT/NL2008/000171, filed Jul. 7, 2008, which claims the benefit of Netherlands Application No. NL 1034103, filed Jul. 5, 2007, the contents of which is incorporated by reference herein.

FIELD OF THE INVENTION

The invention relates to a water-retaining element for forming a temporary water-retaining structure.

BACKGROUND OF THE INVENTION

U.S. Pat. No. 5,511,902 discloses a block that is part of a system for forming a temporary water-retaining structure. The system comprises a plurality of blocks, connecting pins and stakes. The block has an upper surface, a lower surface, four side walls and vertical shafts for accommodating the connecting pins and the stakes. The connecting pins and the corresponding shafts connect the stacked blocks to each other in the vertical direction. The stakes can be inserted by way of a corresponding shaft through the block into a foundation, in order to anchor the block. The block is hollow and can be filled with water through an opening in the upper surface of the block. Said opening is closed by a plug after filling, so that in use the block has a closed top side. The space in the shafts is non-through connected to the space in the water-fillable block.

A disadvantage of U.S. Pat. No. 5,511,902 is that in practice it can take too long for a temporary dam to be constructed. This makes the known system not very suitable for situations in which a temporary water-retaining structure is needed quickly.

SUMMARY OF THE INVENTION

The object of the present invention is at least partially to overcome the abovementioned disadvantage, or at least to provide a usable alternative. In particular, the object of the invention is to provide a water-retaining element which makes it possible to construct a temporary water-retaining structure relatively quickly.

The invention achieves this object by means of a water-retaining element according to the present invention.

A water-retaining element for forming a temporary water-retaining structure comprises a bottom, a plurality of side walls, and connecting means. The plurality of side walls are immovably connected to the bottom and extend upwards from the bottom to form a water-fillable container. The connecting means are designed to connect the water-retaining element in a water-retaining manner to at least one adjacent water-retaining element. The water-fillable container is open at the top so as to receive a second water-retaining element during transport and/or storage.

Owing to the fact that the water-retaining elements of the invention are open at the top so as to receive a second water-retaining element during transport and/or storage, the water-retaining elements can be stacked in a compact stack. This means that more water-retaining elements can be stored in a storage area of a certain size and more water-retaining elements can be transported in a means of transport of a certain size. This makes it possible in times of threatening water shortage to supply more water-retaining elements in a shorter time, so that a temporary water-retaining structure can be formed more quickly than with the blocks of U.S. Pat. No. 5,511,902, while the water-retaining elements do not have to be stored at the location at which the temporary water-retaining structure is to be constructed.

EP-A1-1,614,811 discloses dam construction elements for constructing a temporary water-retaining structure, which can be constructed in the case of threatening floods. The dam construction elements comprise a flexible bottom, side walls extending vertically upwards from the bottom, and a cover with one opening. The side walls are each composed of a plurality of rigid panels, which are flexibly connected to each other. The element is provided with a watertight lining, in the form of a film. On the underside of the bottom there are protrusions, by means of which the element rests on a foundation. The space between the protrusions forms a network of channels, for draining away water which could reach the area below the element.

The water-retaining element disclosed in EP-A1-1,614,811 has the disadvantage that in various conditions it needs to be of great width, meaning that in certain cases a plurality of elements even have to be placed one after the other.

This disadvantage is overcome by a further aspect of the invention, which can be used either separately or in combination with other aspects of the invention.

A water-retaining element for forming a temporary water-retaining structure comprises a bottom, a plurality of side walls, and connecting means. The plurality of side walls extend upwards from the bottom to form a water-fillable container. The connecting means are designed for connecting the water-retaining element in a water-retaining manner to at least one adjacent water-retaining element. The water-retaining element comprises at least one cutting plate, which cutting plate extends downwards from the bottom.

In use, the water-retaining element will be placed on a foundation. The cutting plate will penetrate into the foundation and the water-retaining element thereby provides great resistance to lateral forces exerted by water on the water-retaining element. Such cutting plates furthermore provide resistance to tilting. The water-retaining element according to the invention can therefore be made narrower than the elements of the prior art, which have to provide resistance to lateral forces on the basis of friction with the foundation and resistance to tilting on the basis of their weight and width.

The invention furthermore relates to a water-retaining element for forming a temporary water-retaining structure, comprising a bottom, a plurality of side walls, and connecting means. The plurality of side walls extend upwards from the bottom to form a water-fillable container. The connecting means are designed to connect the water-retaining element in a water-retaining manner to at least one adjacent water-retaining element. The water-retaining element comprises a water-permeable cover, which water-permeable cover rests upon at least two of the side walls and is designed to damp waves.

Through the wave-damping effect of the water-permeable cover, the water-retaining element can be made narrower than is the case in the prior art. This measure can be used either by itself or in combination with other aspects of the invention. Waves will at least partially enter the container through the water-permeable cover, so that the washing of waves over the top of the water-retaining element is reduced or even prevented. In the prior art the same degree of reduction of wave overtopping can be achieved only with higher and/or wider elements.

The invention also relates to a water-retaining element for forming a temporary water-retaining structure, comprising a bottom, a plurality of side walls, and connecting means. The side walls diverge from the bottom relative to each other in such a way that the water-retaining element is stackable so as to nest in a substantially identically shaped water-retaining element.

Thanks to the diverging shape and the resulting nesting stackability, the water-retaining elements can be stored in a compact manner. This measure can be used either by itself or in combination with a cutting plate and/or a water-permeable cover. The compact storage facility is achieved with a more robust water-retaining element than that known from the prior art, since, with a view to the storage, the element disclosed in EP-A1-1,614,811 is of a folding design, in which various rigid parts are flexibly connected to each other. Furthermore, this known element requires a lining.

The invention also applies to a system for forming a temporary water-retaining structure.

The invention furthermore relates to a temporary water-retaining structure, made up of the system for forming a temporary water-retaining structure.

Finally, the invention relates to a method for forming a temporary water-retaining structure.

BRIEF DESCRIPTION OF THE DRAWINGS

The invention will be explained in greater detail with reference to the appended drawing, in which.

DETAILED DESCRIPTION OF PREFERRED EMBODIMENTS

Figure 1:
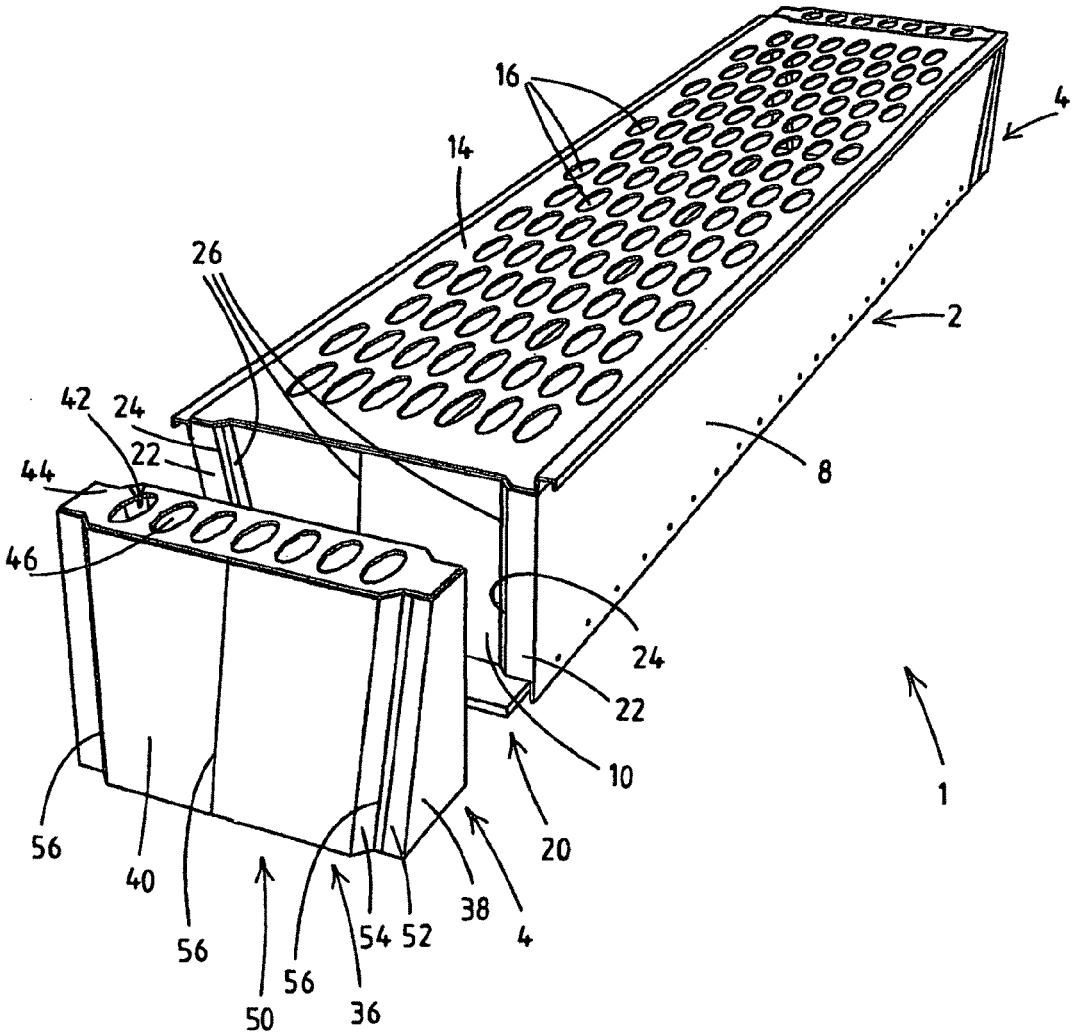
FIG. 1 shows a three-dimensional view of a water-retaining element and two connecting pieces.
Figure 2:
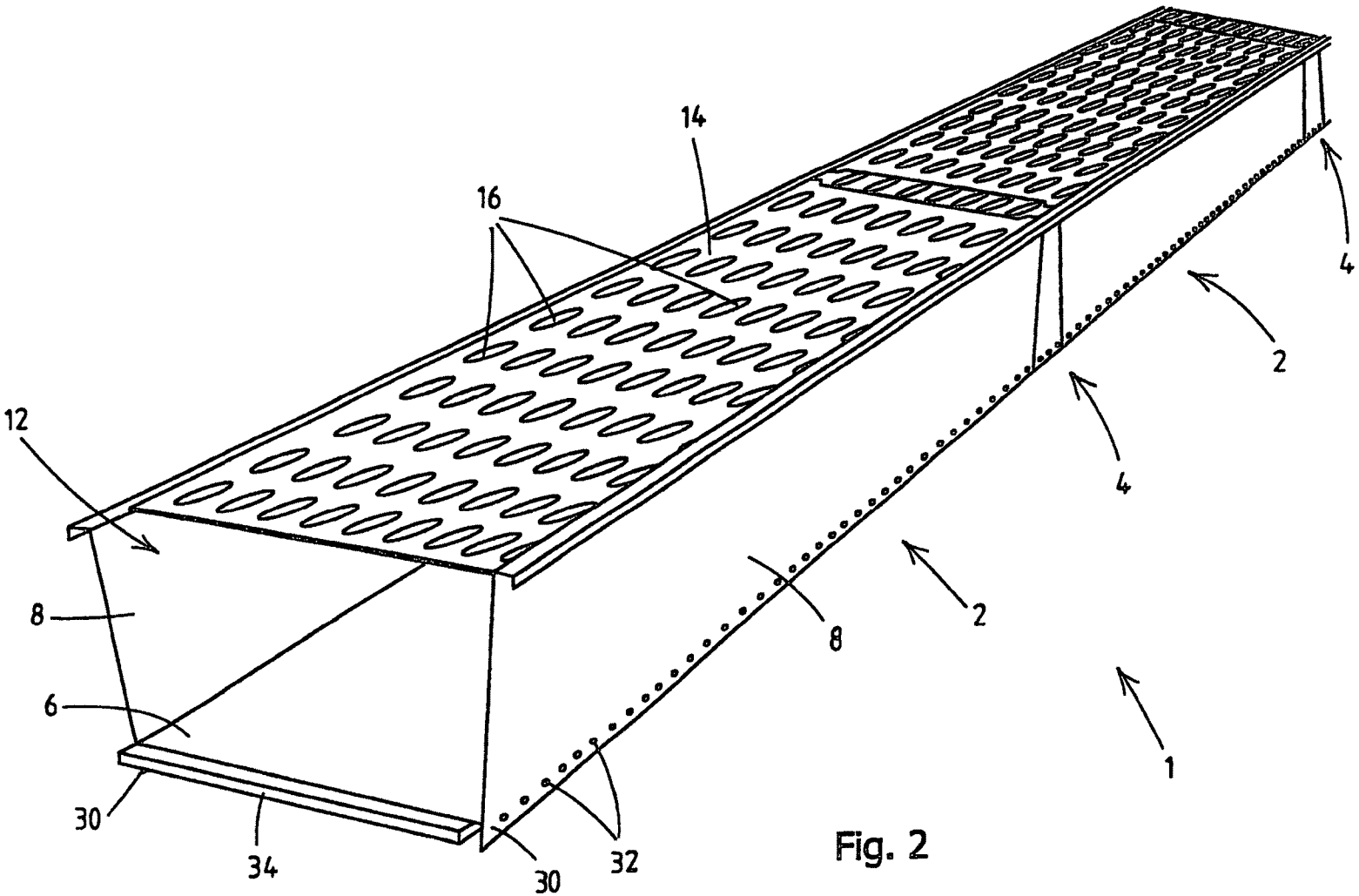
FIG. 2 shows a three-dimensional view of two connected water-retaining elements.

A temporary water-retaining structure according to the invention is indicated in its entirety by reference numeral 1 in FIGS. 1 and 2. The temporary water-retaining structure 1 comprises a plurality of water-retaining elements 2 and a plurality of connecting pieces 4. For the sake of clarity, one of the connecting pieces 4 is shown detached from the water-retaining element 2 in FIG. 1. Likewise for the sake of clarity, a water-retaining element 2 is shown in a cut-away state in FIG. 2.

The water-retaining element 2 comprises a bottom 6 and side walls, in particular longitudinal side walls 8 and transverse side walls 10. Longitudinal direction is defined here as a direction of the water-retaining element, or of the connecting pieces to be described below, extending substantially parallel to the lengthwise direction of the temporary water-retaining structure 1 to be formed. Transverse direction is defined as a direction of the water-retaining element, or of the connecting pieces to be described below, extending substantially transversely to the lengthwise direction of the temporary water-retaining structure 1 to be formed.

The side walls 8 and 10 are immovably connected to the bottom and extend upwards from the bottom 6 to form a water-fillable container 12. The water-fillable container 12 is open at the top and is covered by a removable cover 14. The cover 14 is provided with holes, in this exemplary embodiment oval holes 16. The holes 16 make the cover 14 water-permeable. In this exemplary embodiment 20 to 30% of the surface of the cover is open. The holes 16 are distributed over substantially the entire surface of the water-permeable cover 14. In this exemplary embodiment the holes 16 are uniformly distributed over substantially the entire surface of the water-permeable cover 14 in a pattern of 15 by 7 holes. In use, the water-fillable interior space of the container 12 is in open communication with the environment by way of the holes 16 of the water-permeable cover 14. The cover 14 rests removably on the walls 8 and 10 of the water-retaining element 2.

The side walls 8 and 10 diverge upwards from the bottom 6. This makes it possible, after removal of the cover 14, to stack a plurality of water-retaining elements 2 nested in each other. The term nested means that a water-retaining element 2 on top is not resting fully on a water-retaining element 2 below it, but that it is resting substantially in the water-retaining element 2 below it. In this case the water-retaining element 2 on top will rest with the outside of its side walls 8 and 10 and/or the underside of its bottom 6 on the inside of side walls 8 and 10 and/or the inside of the bottom 6 of the water-retaining element 2 below respectively.

The water-retaining element 2 furthermore comprises connecting means 20, which in this exemplary embodiment are provided on the transverse side walls 10. The connecting means 20 are designed to connect a first water-retaining element 2 in a water-retaining manner to a second water-retaining element 2, in this exemplary embodiment by means of a connecting piece 4, as shown in FIG. 2. The connecting means comprise first and second projecting wall parts 22, 24. The first projecting wall part 22 extends substantially parallel to the corresponding transverse side wall 10. The second projecting wall part 24 in top view forms an obtuse angle with the transverse side wall 10 and the first projecting wall part 22. The connecting means 20 furthermore comprise rubber sealing strips 26, which extend substantially vertically and are provided on the second projecting wall parts 24 and on the transverse side wall 10.

The water-retaining element 2 is provided on an underside of its bottom 6 with two cutting plates 30. In this exemplary embodiment the cutting plates 30 lie in the same plane as the longitudinal side walls 8, and in this case form an integral part of them. The cutting plate 30 is considered to be the part of the longitudinal side wall 8 extending below the level of the bottom 6. The cutting plate 30 is water-permeable, in this exemplary embodiment through the fact that it is provided with water-permeable openings 32. Although in this exemplary embodiment both cutting plates 30 are provided with such openings 32, it may be sufficient to provide only one cutting plate 30 with such openings. A drainage mat 34 extends below the bottom 6 of the water-retaining element between the two cutting plates 30.

The connecting piece 4 comprises a bottom (indicatively shown by reference numeral 36, but in fact not visible in the three-dimensional views). The connecting piece 4 furthermore comprises longitudinal side walls 38 and transverse side walls 40. The longitudinal side walls 38 and the transverse side walls 40 extend from the bottom 36 to form a water-fillable container 42. The longitudinal side walls 38 here diverge relative to each other, viewed from the bottom 36. The transverse side walls 40 converge relative to each other, viewed from the bottom 36.

The connecting piece 4 in this exemplary embodiment is provided with a cover 44, provided with oval water-permeable openings 46. The cover 44 rests removably upon the edges of the side walls 38 and 40.

The connecting piece 4 is provided with connecting means 50, which are complementary to the connecting means 20 of the water-retaining elements 2. The connecting means 50 of the connecting piece 4 comprise receding wall parts 52 and 54. The receding wall parts 52 and 54 are complementary to the projecting wall parts 22, 24 of the water-retaining element 2. The connecting means 50 of the connecting piece 4 furthermore comprise grooves 56, which are complementary to the rubber strips 26 of the water-retaining element 2.

The side walls 8 and 10 of the water-retaining element 2 form an angle of substantially 96° with the bottom 6. More generally, the side walls 8 and 10 of the water-retaining element 2 form an angle of 90 plus x degrees with the bottom 6, x being greater than 0 and preferably less than 25°. The longitudinal side walls 38 of the connecting piece 4 form the same angle with the corresponding bottom 36 of the connecting piece 4 as the longitudinal side walls 8 of the water-retaining element 2. The transverse side walls 40 of the connecting piece 4 form an angle of 84° with the corresponding bottom 36 of the connecting piece 4. More generally, the transverse side walls 40 of the connecting pieces 4 form an angle with their bottom 36 that is complementary to the angle formed by the transverse side wall 10 of the water-retaining element. Where the transverse side walls 10 of the water-retaining element 2 form an angle of 90 plus x degrees with the bottom 6, the transverse side walls 40 of the connecting piece 4 form an angle of 90−x degrees.

The water-retaining elements 2 and the connecting pieces 4 together form a system for the construction of a temporary water-retaining structure. One or more stacks, each with a plurality of water-retaining elements 2, is/are supplied by a means of transport such as a lorry or a ship. The temporary water-retaining structure 1 is constructed by placing a first water-retaining element 2 on a foundation and placing a connecting piece 4 against one transverse side wall or both transverse side walls 10. The connecting piece 4 is provided here with its transverse side wall 40 against a corresponding slantingly shaped transverse side wall 10 of a water-retaining element 2. In the assembled state the corresponding transverse side walls 10, 40 thus rest against each other substantially parallel to each other. In a corresponding manner, the projecting wall parts 20 lie against the receding wall parts 52, and the projecting wall parts 24 against the receding wall parts 54. Furthermore, the rubber strips 26 are accommodated in the correspondingly shaped grooves 56. In this way a water-retaining seal is achieved between a water-retaining element 2 and a connecting piece 4.

A following water-retaining element 2 is then placed against a connecting piece 4 placed in this way, the transverse side walls and receding and projecting wall parts ultimately lying against each other as described above. After this following water-retaining element 2 has been placed, the connecting piece 4 can no longer be removed, because it is bounded by the projecting wall parts 24 and 54 in a direction crosswise to the water-retaining elements 2 that extend in a longitudinal direction. In an upward direction the connecting piece 4 is bounded by the transverse side wall 10 and the projecting wall parts 22 and 24 of the water-retaining element 2.

After the placing of a number, preferably all, of the water-retaining elements 2 and connecting pieces 4, the corresponding containers 12 and 42 are at least partially filled with water. Alternatively, or in addition to this, the containers 12 and 42 can also be filled with another heavy material, such as sand. Through the combined weight of the water-retaining elements 2 and the water, the cutting plates 30 will cut into the foundation. Said cutting plates 30 preferably cut so far into the foundation that the water-retaining element 2 also presses with its bottom 6 on the foundation. It is pointed out here that the pressure concerned is exerted by way of the drainage mat 34. The cutting plates 30 provide resistance to transverse shifting of the water-retaining elements 2 relative to the foundation. This resistance, combined with the weight of the filled container 12, ensures that a temporary water-retaining structure thus formed can withstand water pressure exerted on one side of the temporary water-retaining structure 1. This is shown diagrammatically in FIG. 4 for an otherwise slightly different embodiment of a water-retaining element according to the invention.

Before or after filling of the water-retaining elements 2, the removable water-permeable cover 16 is fitted on the side walls of the water-retaining element. If desired, the drainage mat 34 is placed on the foundation before placing of the water-retaining elements.

In this way a temporary water-retaining structure 1 can be provided, for example on the crest of a dike which is not expected to be sufficiently high to withstand a predicted water level. A temporary water-retaining structure 1 can, however, also be provided around an area that is intended as a temporary water storage facility. The temporary water-retaining structure 1 here can even be provided on a substantially horizontal foundation, but it can also, of course, be provided on an already existing ring dike to raise this ring dike. For the formation of a temporary water storage facility, the temporary water-retaining structure 1 preferably forms a closed contour, in which a part of this closed contour can possibly also be formed by other water-retaining means, including permanently present structures. The temporary water-retaining structure 1 can also form a closed contour around objects, such as buildings, for example houses or farms in a flood plain. Instead of protecting the entire object, the temporary water-retaining structure 1 can also be used to seal water-permeable openings of such an object.

The cutting edge 30 preferably extends so deeply into the foundation that it stops or at least partially prevents percolating water from flowing through underneath the temporary water-retaining structure 1. In order to prevent percolating water from exerting an upward force upon the water-retaining elements 2, the water-permeable openings 32 are provided in at least one of the cutting edges. This means that a limited quantity of percolating water can flow from underneath the water-retaining element 2, so that excess pressure is avoided. The drainage mat 34 is provided in order to prevent percolating water from accumulating locally underneath the water-retaining element 2. By means of this drainage mat 34, percolating water can flow away to the water-permeable openings 32.

In use, water can be present on a water side of the temporary water-retaining structure 1. Said structure here serves to prevent this water from flowing over the top of, through, or underneath the temporary water-retaining structure 1 to a land side of the temporary water-retaining structure 1. The longitudinal side wall 8 situated on the water side will be referred to below as the first longitudinal side wall. The longitudinal side wall 8 situated on the land side will be referred to below as the second longitudinal side wall.

It is very conceivable that the temporary water-retaining structure 1 may not only be subjected to a static water pressure load, but that there may also be waves on the water. If such waves wash over the top of the first longitudinal side wall 8, the wave part concerned will go onto the water-permeable cover 14. This wave part will then at least partially pass through the openings 16 into the container 12. In a corresponding manner, a part of a wave can also pass into the container 42 of the connecting piece 4, although this is not essential for good functioning of this aspect of the invention. Thanks to the water-permeable cover 14, a large part of the wave energy will already be dispersed before the water passes through the openings 16 and into the container 12. Remaining wave energy from the water flowing into the container 12 can lead to local wave formation in this container. The water-permeable cover 14 then ensures that at least the major part of this water does not flow over the top of the second longitudinal side wall 8.

In this way it is ensured that the washing of waves over the top of the temporary water-retaining structure is prevented, or at least reduced in an effective manner. This effect is achieved by a water-retaining element 2 that can remain narrower than a water-retaining structure which is not provided with a water-permeable cover. For the sake of completeness, it is pointed out that water coming from waves can make the permanent water level in the container 12 increase. In order to prevent the container 12 from becoming so full that it still threatens to overflow on the inside, run-off facilities (not shown) are provided on the water side of the temporary water-retaining structure 1. Such a run-off facility can be formed easily by making the longitudinal side wall 8 concerned end at a lower level than the longitudinal side wall 8 situated opposite. Alternatively, the longitudinal side wall 8 concerned can be provided with outflow openings at the desired maximum water level.

Figure 3:
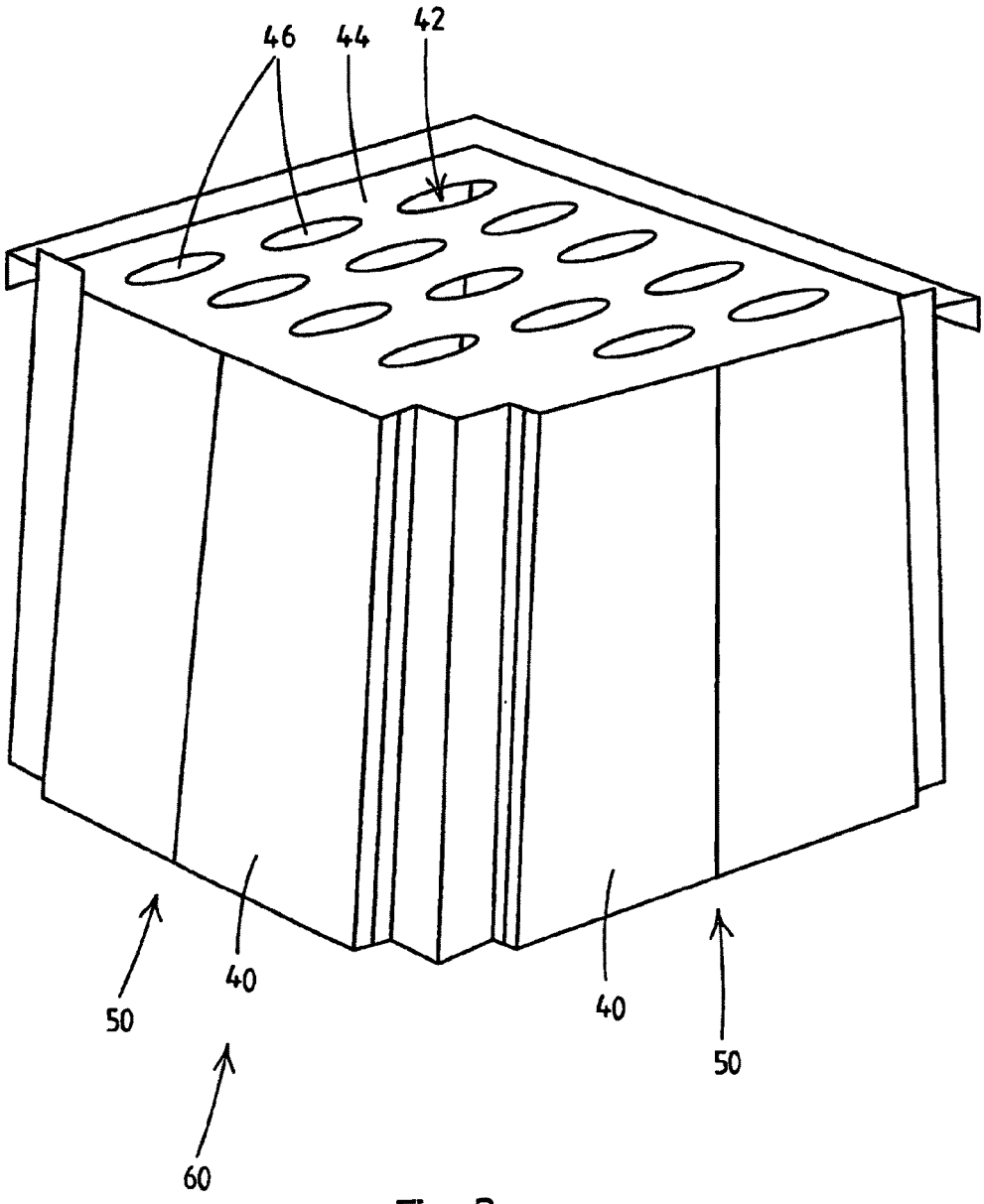
FIG. 3 shows a corner connecting piece.

FIG. 3 shows a special form of connecting piece, which is indicated here by reference numeral 60. The corner connecting piece 60 has transverse side walls 40, and connecting means 50 which are comparable, in particular are identical, to the corresponding parts of the connecting piece 6. The transverse side walls 40 concerned and their connecting means 50 are provided at an angle to each other in top view, in this case an angle of 90°. Alternatively, other angles in the range between 0 and 180° can be used. Through the use of such corner connecting pieces 60, a temporary water-retaining structure can form angles, for example for following a contour of an existing dike, or for forming a closed contour. It is advantageous here to have in stock a number of corner connecting pieces whose transverse side walls 40 are at various angles to each other. In a variant which is not shown, such a corner connecting piece can also be of a wedge shape, in other words the corner connecting piece concerned has a longitudinal side wall that is longer than one longitudinal side wall lying opposite it.

Figure 4:
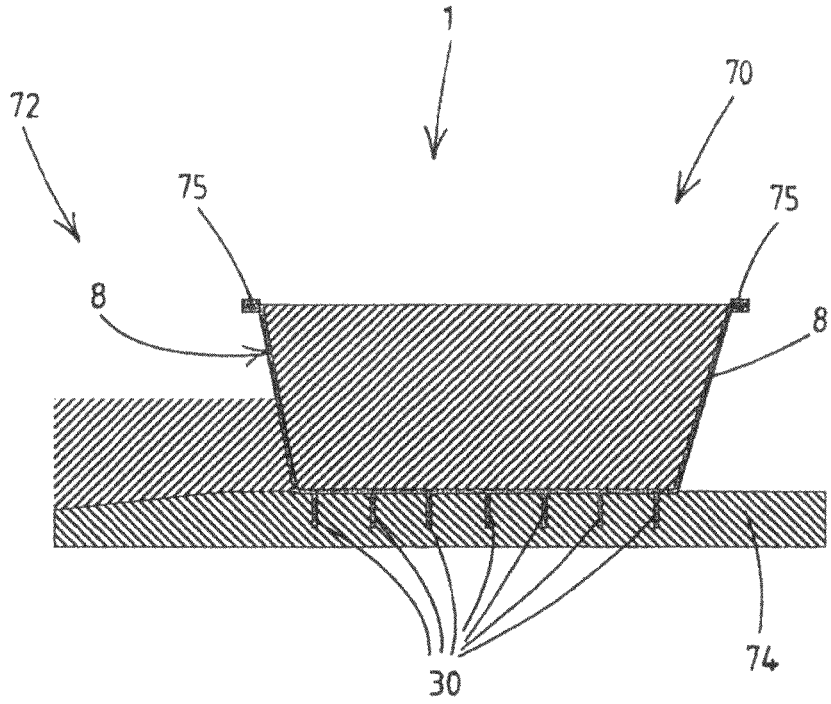
FIG. 4 shows a diagrammatic view of an alternative embodiment in use.

FIG. 4 shows diagrammatically in cross section an alternative water-retaining element 70. The water-retaining element 70 is provided with more than two, in this case seven, cutting plates 30. At least six of the cutting plates 30 are provided with water-permeable openings (not shown). In this exemplary embodiment the cutting plates 30 are not in line with the longitudinal side walls 8, but they do extend downwards from the bottom concerned.

FIG. 4 furthermore shows diagrammatically how a temporary water-retaining structure 1 is formed. On a water side 72 of the temporary water-retaining structure 1, water is retained by the corresponding first longitudinal side wall 8 of the water-retaining element 70 facing the water side. In order to ensure that they can withstand the pressure from the water, the cutting plates 30 are situated in a foundation 74.

Water-retaining elements according to the invention can be produced in various sizes and from different materials. The water-retaining elements are preferably made substantially of a plastic, such as a fibre-reinforced plastic. A metal tube can be fixed along a top edge of the longitudinal side walls 8 here, for reinforcement. Such a reinforcement may be necessary to prevent the water-retaining element from deforming under the water pressure. The metal tube can be advantageously provided with crane hooks. In the exemplary embodiment of FIG. 4 it is a steel tube, indicated diagrammatically by 75. The steel tube 75 in this exemplary embodiment has a cross section of 0.10 by 0.05 meter. An exemplary embodiment (not shown) of a cover is hingedly connected on one longitudinal edge to a top edge of one of the two longitudinal side walls. The opposite longitudinal edge of the cover is detachably interlocked with the other longitudinal side wall, for example by means of a snap connection. Alternatively, the hinged connection can also be replaced by an interlocking detachable connection. An advantage of these methods of connection is that the cover stiffens the longitudinal side walls, so that the resistance to bending under water pressure is increased and a metal tube is not necessary, or can be of a lighter construction. A fully removable cover makes the nesting stacking easier. With hinged covers, nesting stackability is also possible, for example by placing the covers converging upwards during the stacking.

In one embodiment the bottom 6 can have dimensions of 4 by 2 meters, the water container, because of the diverging of the side walls, acquiring dimensions of 4.4 by 2.4 meters. A suitable height here is, for example, 1.1 meters. An alternative container can have a longitudinal measurement of 6 meters, a width of 1.2 meters and a height of 0.7 meter. More generally, the longitudinal measurement of the bottom will be between 1 and 10 meters, preferably between 2 and 8 meters. The width measurement will generally be between 0.5 and 4 meters, preferably between 1 and 3 meters. The height will generally be between 0.5 and 2 meters.

The plastic of the water-retaining element is preferably 5 to 15 mm thick, particularly 5 to 10, and more particularly 8 mm thick. Instead of a combination of plastic and metal, it is, of course, also possible to make a water-retaining element according to the invention in its entirety of plastic, or in its entirety of a metal, such as steel, or of other materials, such as wood. The water-retaining elements of the exemplary embodiments shown are rectangular in top view. Alternatively, the water-retaining elements can be curved or polygonal, including triangular and hexagonal.

The cutting plate of the invention extends downwards. It is already clear from the exemplary embodiments shown that this must also be understood to include both a substantially completely vertical orientation and an orientation of several degrees relative to the vertical. This orientation is such that the cutting plate can penetrate into the foundation. For this purpose, the orientation is expediently less than 30 degrees, particularly less than 15 degrees, and more particularly less than 10 degrees relative to the vertical. The cutting plate needs not extend uninterruptedly over the full length of the water-retaining element, but can also comprise a number of shorter plates. The water-permeability of the cutting plates can also be achieved in a way other than by means of the openings shown, for example by providing membranes and/or flow-through openings in the bottom of the water-retaining element, along the top of the cutting plates. A water-retaining element according to the invention can also be designed without cutting plate. This is particularly advantageous in the case of a hard foundation, such as a foundation with paving.

The side walls can extend either substantially vertically upwards or at an angle to the vertical of 0 to 45 degrees. Water-retaining elements with substantially vertical side walls are also stackable so as to nest in each other by stepwise reduction of the length and width of a successive series of water-retaining elements to be stacked in each other. The length and width of a water-retaining element here is at least twice the wall thickness less than the length and width of a water-retaining element in which the smaller water-retaining element is to be stacked so as to nest in it. Furthermore, it is also possible to use connecting means other than those shown, which also do not have to be integral with the transverse side walls. For instance, mechanical connecting means, such as locks, can be fixed on the longitudinal side walls, or a tongue and groove connection or fully interlocking connecting means can be used. A connection based on friction or suction force can also be provided. Moreover, the water-retaining elements can be connected directly to each other, i.e. without the connecting piece. This connecting piece is particularly advantageous in combination with nest able water-retaining elements for connecting two slanting (diverging) transverse side walls to provide a water-retaining structure, the connecting piece having complementary converging transverse side walls and thus differing in shape from the water-retaining elements. The connecting pieces shown are short compared with water-retaining elements, but they can also be of the same length.

The water-permeable cover can also be water-permeable in alternative ways, for instance by means of a membrane. A membrane may be regarded as a surface with a fine pattern of holes. Although such a pattern in a membrane in theory has a finite number of holes, this number is seen as infinite here. In addition to the pattern of holes shown in the exemplary embodiment, patterns with more or fewer holes are possible. In general, it is advantageous to have a pattern with at least six holes in the widthwise direction and a pattern of at least ten holes in the lengthwise direction. At least 10% of the surface area of the water-permeable cover is preferably open. In addition, preferably a maximum of 75%, and more preferably 50%, of the surface area of the cover is open. The cover can also be provided with additional wave-dispersing means, such as corrugations on the upper and/or lower side of the cover. The cover does not have to rest on all longitudinal side walls, but can, for example, rest only on a part of the longitudinal side walls, or on parts of the longitudinal side walls.

The invention claimed is:

1. A system for forming a temporary water-retaining structure, comprising a plurality of water-retaining elements, the water-retaining elements comprising a bottom, a plurality of side walls, and connecting means, which water-retaining elements can be connected to each other by means of the connecting means, which plurality of side walls are immovably connected to the bottom and extend upwards from the bottom to form a water-fillable container, and which connecting means are designed to connect the water-retaining elements in a water-retaining manner to at least one adjacent water-retaining element, wherein the water-fillable container is open at the top so as to receive a second water-retaining element during transport and/or storage, which system further comprises at least one connecting piece, comprising a bottom and a plurality of side walls, which plurality of side walls extend upwards from the bottom to form a water-fillable container, which connecting piece differs in shape and/or size from the water-retaining element and is provided with connecting means which are complementary to the connecting means of the water-retaining element, and wherein at least one of the side walls of at least one of the at least two water-retaining elements forms an angle of more than 90 degrees relative to the bottom of the corresponding water-retaining element and at least one side wall of the connecting piece forms a complementary angle of less than 90 degrees relative to the bottom of the connecting piece.

2. The system according to claim 1, in which the side walls diverge from the bottom relative to each other in such a way that the water-retaining element is stackable so as to nest in a substantially identically shaped water-retaining element.

3. The system according to claim 1, wherein the water-retaining element comprises a removable cover, which in use rests on at least two of the side walls.

4. The system according to claim 3, wherein the removable cover is water-permeable, which removable water-permeable cover is designed for damping waves.

5. The system according to claim 1, wherein the water-retaining element comprises at least one cutting plate, which cutting plate extends downwards from the bottom.

6. The system according to claim 5, wherein the water-retaining element comprises at least a second cutting plate, at least one of the cutting plates being at least partially water-permeable, and in particular being provided with water-permeable openings.

7. The system for forming a temporary water-retaining structure according to claim 1, which system comprises a drainage mat, which drainage mat can be provided between an underside of the bottom of the water-retaining element and a foundation for the temporary water-retaining structure.

8. A temporary water-retaining structure, composed of the system for forming a temporary water-retaining structure according to claim 1.

9. The system according to claim 1, in which a successive series of water-retaining elements with substantially vertical side walls are stackable so as to nest in each other by stepwise reduction of the length and width of the successive series of water-retaining elements.

10. A method for forming a temporary water-retaining structure, comprising the steps of:

providing a stack of at least two water-retaining elements stacked nesting in each other;

taking out of the stack a first of the at least two water-retaining elements stacked nesting in each other;

placing the first of the at least two water-retaining elements on a foundation;

placing a second of the at least two water-retaining elements on the foundation, in such a way that the connecting means of the first and the second water-retaining element engage with each other; and filling the at least two water-retaining elements with water, furthermore comprising:

placing a connecting piece, comprising a bottom and a plurality of side walls, which plurality of side walls extend upwards from the bottom to form a water-fillable container, which connecting piece differs in shape and/or dimensions from the water-retaining element, in which the first water-retaining element and the second water-retaining element engage with each other by means of the connecting piece.

11. The method according to claim 10, in which at least three water-retaining elements are provided, which water-retaining elements are placed in such a way that a closed contour is produced to form a temporary water storage facility, or to protect an object.

* * * * *